US008353504B2

(12) United States Patent
Hattori et al.

(10) Patent No.: US 8,353,504 B2
(45) Date of Patent: Jan. 15, 2013

(54) SHEET FOLDING APPARATUS

(75) Inventors: Minoru Hattori, Aichi (JP); Akihiro Tsuno, Nagoya (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/067,255

(22) Filed: May 19, 2011

(65) Prior Publication Data

US 2011/0301009 A1 Dec. 8, 2011

(30) Foreign Application Priority Data

Jun. 2, 2010 (JP) ..... 2010-127090

(51) Int. Cl.
*B31F 1/00* (2006.01)

(52) U.S. Cl. ..... 270/45; 270/32

(58) Field of Classification Search ..... 270/32, 270/45, 58.07; 493/406, 407, 416, 422, 424, 493/436

See application file for complete search history.

(56) References Cited

U.S. PATENT DOCUMENTS

| | | | | |
|---|---|---|---|---|
| 3,752,469 | A | 8/1973 | Kistner | |
| 5,570,877 | A | 11/1996 | Asami et al. | |
| 5,655,765 | A | 8/1997 | Asami et al. | |
| 5,788,229 | A | 8/1998 | Asami et al. | |
| 6,511,407 | B2 * | 1/2003 | Wahl | 493/405 |
| 6,921,069 | B2 * | 7/2005 | Suzuki et al. | 271/207 |
| 7,673,862 | B2 * | 3/2010 | Kushida et al. | 270/32 |
| 7,731,187 | B2 | 6/2010 | Horio et al. | |
| 2007/0176357 | A1 | 8/2007 | Horio et al. | |

FOREIGN PATENT DOCUMENTS

| | | |
|---|---|---|
| GB | 1 534 578 | 12/1978 |
| JP | 2000143081 A | 5/2000 |
| JP | 2004210436 A | 7/2004 |
| JP | 3875802 B | 11/2006 |

OTHER PUBLICATIONS

European Search Report dated Sep. 14, 2011 issued in corresponding European Application No. 11250513.6.

* cited by examiner

*Primary Examiner* — Leslie A Nicholson, III
(74) *Attorney, Agent, or Firm* — Harness, Dickey & Pierce, P.L.C.

(57) ABSTRACT

A sheet folding apparatus includes a blade member having an edge configured to push a surface of a sheet so as to push the sheet into a sheet folding unit configured to fold the sheet, a pair of nipping members that is included in the sheet folding unit and nips the sheet pushed into the sheet folding unit by the blade member, a blade member moving unit that moves the blade member and a nipping member moving unit that moves the pair of nipping members. The blade member moving unit and the nipping member moving unit are driven by the same driving unit.

8 Claims, 13 Drawing Sheets

SHEET FOLDING APPARATUS

CROSS-REFERENCE TO RELATED APPLICATIONS

The present application claims priority to and incorporates by reference the entire contents of Japanese Patent Application No. 2010-127090 filed in Japan on Jun. 2, 2010.

BACKGROUND OF THE INVENTION

1. Field of the Invention

The present invention relates to a sheet folding apparatus that performs a folding process on a fed sheet.

2. Description of the Related Art

Known as a type of such sheet folding apparatuses is a sheet folding apparatus that performs a folding process on a sheet on which an image has been formed by an image forming apparatus. The sheet folding apparatus disclosed in Japanese Patent Application Laid-open No. 2004-210436 includes a pushing blade that pushes a sheet in a perpendicular direction at a position to be folded, a stopper plate that stops the sheet pushed by the pushing blade, and a pair of pressing blades that is arranged facing each other across a moving path of the pushing blade and nips to press the sheet. The pair of pressing blades is disposed movably along a sloped guide arranged in a V shape, so that the space between edges of the pair of pressing blades is widened in a standby position, and the space between the edges of the pair of pressing blades is narrowed in a sheet nipping position. After the pushing blade pushes the sheet against the stopper plate at the position of the sheet to be folded, the pair of pressing blades is moved from the standby position to the sheet nipping position. Both sides of the sheet at the position to be folded is nipped and pressed by the edges of the pair of pressing blades, while being rubbed by the edges of the pair of pressing blades. In this manner, the sheet is folded.

The pushing blade and the pair of pressing blades are moved respectively by a pushing blade moving unit and a pressing blade moving unit each of which is driven by driving force of a motor that is a driving unit. However, if driving units that drive the pushing blade moving unit and the pressing blade moving unit are provided separately, the cost and the size of the image forming apparatus increase.

SUMMARY OF THE INVENTION

It is an object of the present invention to at least partially solve the problems in the conventional technology.

According to an aspect of the present invention, there is provided a sheet folding apparatus including: a blade member having an edge configured to push a surface of a sheet so as to push the sheet into a sheet folding unit configured to fold the sheet; a pair of nipping members that is included in the sheet folding unit and nips the sheet pushed into the sheet folding unit by the blade member; a blade member moving unit that moves the blade member between a pushing position where the blade member pushes the sheet into the sheet folding unit and a position retracted from the pushing position; and a nipping member moving unit that moves the pair of nipping members between a nipping position where the pair of nipping members nip the sheet and a position, retracted from the nipping position. The sheet folding apparatus configured to fold the sheet by nipping the sheet between the pair of nipping members. The blade member moving unit and the nipping member moving unit are driven by the same driving unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Described below is an exemplary embodiment in which the present invention is applied to a sheet post-processing apparatus that performs a folding process on a sheet discharged from an image forming apparatus as a post-process.

Figure 2:
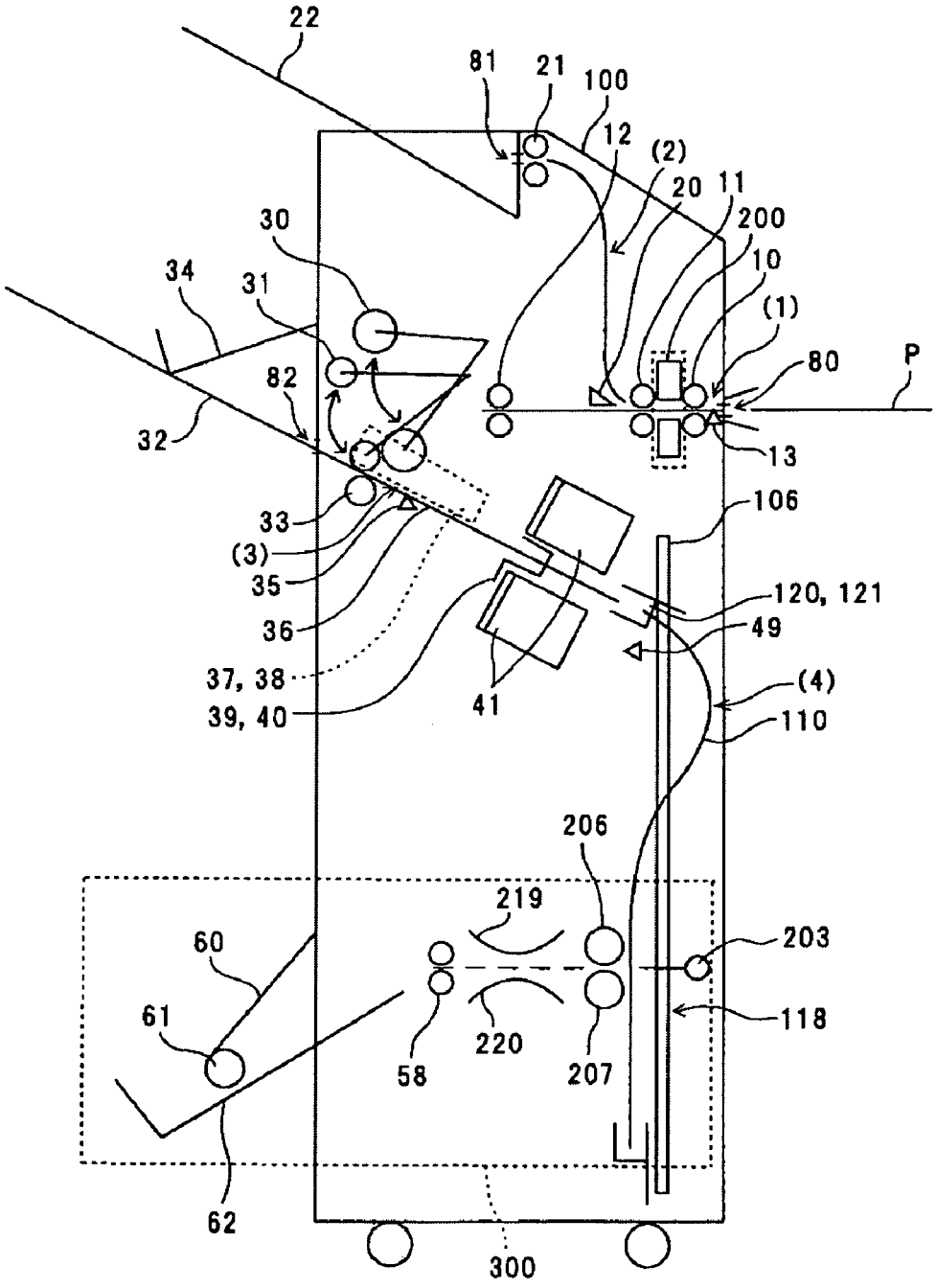
FIG. 2 is an entire schematic of a structure of a sheet folding apparatus.

FIG. 2 is a schematic of the structure of a sheet post-processing apparatus 100 according to the embodiment. The sheet post-processing apparatus 100 is installed on a side of an image forming apparatus not illustrated, receives a sheet P on which an image is formed by the image forming apparatus through a receiving port 80 arranged on a side wall of the sheet post-processing apparatus 100, and performs a folding process and the like on the sheet P.

The sheet post-processing apparatus 100 includes a introduction path 1 configured to introduce the sheet P into the sheet post-processing apparatus 100 via the receiving port 80, a conveying path 2 configured to convey the sheet P to a discharge tray 22, a conveying path 3 configured to intermediately accumulating the sheet P, and a conveying path 4 configured to convey a sheet bundle, which has been bound at the center along the sheet length direction in the conveying path 3, to a sheet folding unit.

A pair of entrance rollers 10 and an entrance sensor 13 are disposed near the receiving port 80 in the introduction path 1. The entrance sensor 13 detects a sheet P being conveyed into the sheet post-processing apparatus 100 through the receiving port 80, and the pair of entrance rollers 10 conveys the sheet P downstream in the sheet conveying direction of the introduction path 1. A sheet punching unit 200 that punches a hole in the sheet P is arranged downstream of the pair of entrance rollers 10 in the sheet conveying direction of the introduction path 1. Further, a pair of conveying rollers 11 and a pair of conveying rollers 12 are disposed downstream of the sheet punching unit 200 in the sheet conveying direction. The sheet P is conveyed from the introduction path 1 into the conveying path 3 through these components. The pair of conveying rollers 12 is configured to be movable to a certain degree in the vertical directions in the sheet post-processing apparatus 100 by a shifting mechanism not illustrated.

A branching claw 20 configured to switch the conveying direction of the sheet P between the conveying path 2 and the conveying path 3 is disposed downstream of the pair of conveying rollers 11 in the sheet conveying direction in the introduction path 1. The conveying path 2 is configured to convey the sheet P having been conveyed in the introduction path 1 to the discharge tray 22. The sheet P having its travelling direction changed by the branching claw 20 from the introduction path 1 passes through the conveying path 2, and is conveyed to the discharge tray 22 via a discharging port 81 by discharging rollers 21 disposed at a downstream end of the conveying path 2 in the sheet conveying direction.

A conveying roller 33, a driven roller 31, and a sheet discharging sensor 35 are arranged along the conveying path 3. In a sorting mode, the pair of conveying rollers 12 in the introduction path 1 is moved in a downward direction (a direction perpendicular to the conveying direction) by a certain distance by the shifting mechanism using a driving unit not illustrated while the sheet P is nipped between and conveyed by the pair of conveying rollers 12. As a result, the position of the sheet P nipped between the pair of conveying rollers 12 is shifted in the downward direction by the certain distance as well. Accordingly, the sheet P is guided from the introduction path 1 into the conveying path 3, and is nipped between and conveyed by the conveying roller 33 and the driven roller 31, so that the sheet P is discharged from a discharging port 82 onto a discharge tray 32, and stacked thereon sequentially.

The driven roller 31 is arranged in a swingable manner so that the driven roller 31 can be brought into contact with and be separated from the conveying roller 33. By bringing and separating the driven roller 31 into contact with and from the conveying roller 33, the driven roller 31 can be moved, in a selectable manner, between a closed position where the sheet P is nipped between and conveyed by the conveying roller 33 and the driven roller 31 to discharge onto the discharge tray 32 and an opened position where the sheet P is not nipped between the conveying roller 33 and the driven roller 31. When the sheet P is guided from the introduction path 1 into the conveying path 3 by shifting the sheet P using the pair of conveying rollers 12 in the introduction path 1, the conveying roller 33 and the driven roller 31 are separated and kept in the opened positions. When shifting the sheet P using the pair of conveying rollers 12 is completed, the driven roller 31 is brought into contact with the conveying roller 33 to be brought into the closed position, and the conveying roller 33 and the driven roller 31 nip the sheet P therebetween and convey the sheet to discharge the sheet P onto the discharge tray 32 via the discharging port 82.

Near and above the discharging port 82 on the side wall of the sheet post-processing apparatus 100 where the discharging port 82 is formed, a feeler 34 is disposed to be rotatable about a root portion thereof attached to the side wall so that an edge of the feeler 34 is brought into contact with the surface of the sheet P stacked on the discharge tray 32 near the center of the sheet P. A top surface detecting sensor (not illustrated) used to detect the height position of the edge of the feeler 34 is arranged near the root portion of the feeler 34 so as to detect the stacked height of sheets P stacked on the discharge tray 32 based on the detection result of the top surface detecting sensor.

When the stacked height of the sheets P is increased due to increase in a number of the sheets P accumulated on the discharge tray 32 and thus the feeler 34 is rotated upwardly to turn ON the top surface detecting sensor, a controller not illustrated included in the sheet post-processing apparatus 100 controls a driving unit (not illustrated), configured to raise and lower the discharge tray 32, to lower the discharge tray 32. As the discharge tray 32 is lowered and the feeler 34 is rotated downwardly in association With lowering of the discharge tray 32, the top surface detecting sensor is turned OFF to cause the controller to control the driving unit to stop lowering the discharge tray 32. When the discharge tray 32 reaches a specified tray-full height after these operations are repeated, the controller included in the sheet post-processing apparatus 100 issues a stop signal to the image forming apparatus to stop an image forming operation performed by the image forming apparatus.

A staple tray 36 and a tapping roller 30 are disposed along the conveying path 3. A stapler 41 divided into a driver and a clincher moving back and forth in the direction perpendicular to the sheet surface is disposed at an end of the conveying path 3. The conveying path 3 also includes jogger fences 37 and 38 configured to move back and forth in the direction perpendicular to the sheet surface to align the sheet P on the staple tray 36.

The sheet P conveyed from the introduction path 1 into the conveying path 3 is guided onto the staple tray 36, and is aligned in the width direction by the jogger fences 37 and 38. The tapping roller 30 is moved in a pendular motion in the counterclockwise direction in FIG. 2, being brought into contact with a top surface of the sheet P so as to switch back the sheet P toward the stapler 41, thereby bringing a trailing edge of the sheet P against reference fences 39 and 40 to align the sheet P in its length direction. In an edge binding mode, the sheet P thus aligned in the width direction and the length direction is bound by moving the stapler 41 in a direction perpendicular to the surface of the sheet P, and stapling an appropriate position of the lower edge of the sheet bundle using the stapler 41. The driven roller 31 and the conveying roller 33 then nip and convey the sheet bundle to discharge the sheet bundle onto the discharge tray 32.

In a saddle stitch binding mode, after alignment of the sheet P in the width direction and the length direction and stapling of the sheet P are completed, the trailing edge of the sheet P is clamped by a clamping unit R. The reference fences 39 and 40 are retracted to positions outside of the width of the sheet P in the width direction so as not to interfere the sheet conveying operation.

The clamping unit R is attached to vertical clamp shafts 106 arranged outside of a side plate, and is moved in the vertical and horizontal directions along the curved conveying path 4. The clamping unit R moves in the vertical direction along the vertical clamp shaft 106, and moves in the horizontal direction along guide rails 110 formed on the side plate of the apparatus along the same trajectory as the conveying path 4. By causing the clamping unit R to move in this manner, the sheet P having the trailing edge thereof clamped by the clamping unit R is conveyed along the trajectory of the conveying path 4 (the guide rails 110) to a predetermined position depending on the sheet size. An appropriate position at the center of the sheet bundle in its length direction is then stapled by the stapler 41 to be saddle stitched. The predetermined position depending on the sheet size is determined based on transmission of a predetermined number of pulses after a position of a clamp movable fence home position sensor 49.

Figure 3:
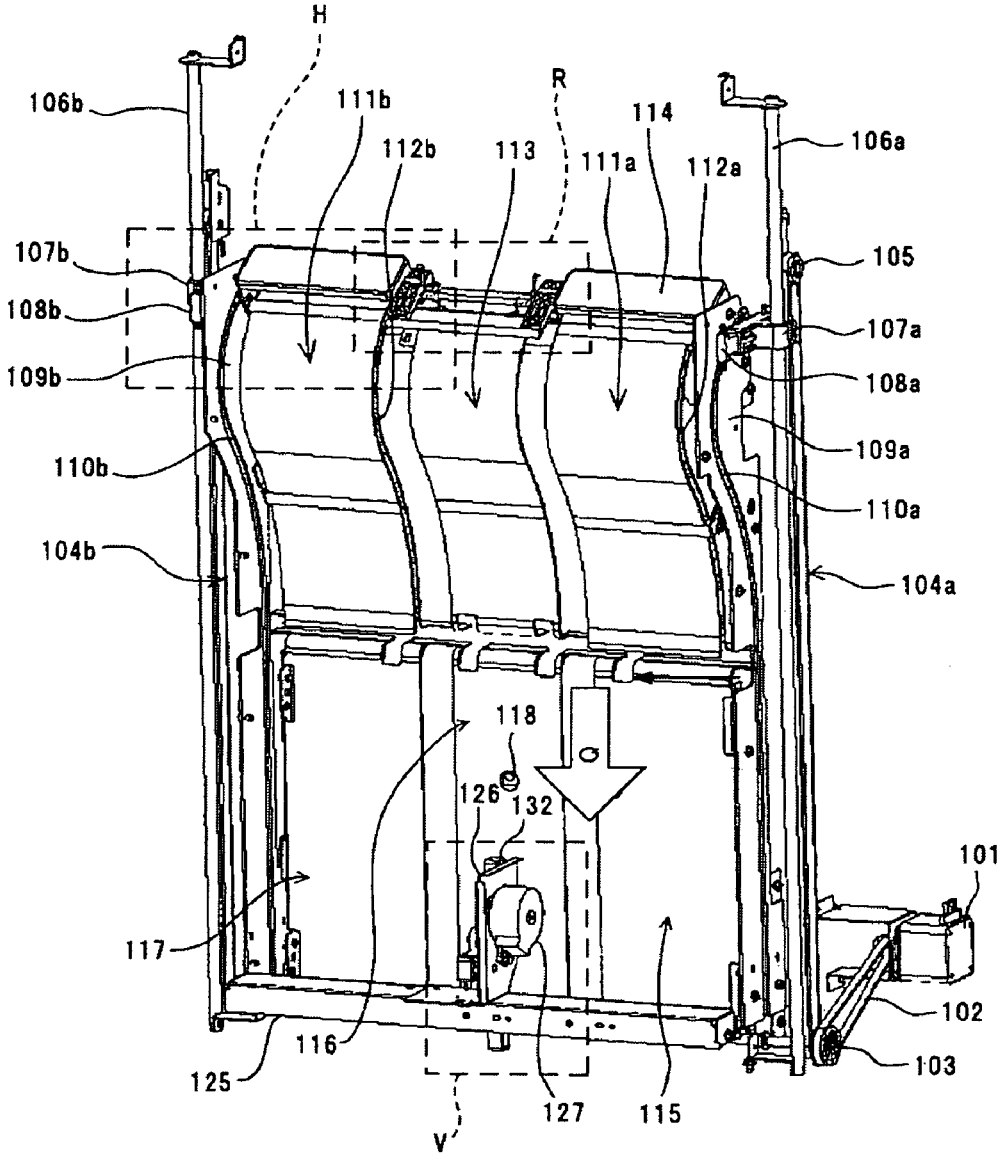
FIG. 3 is an entire schematic of a clamped bundle conveying unit.

FIG. 3 is an entire schematic of a clamped bundle conveying unit.

In the clamped bundle conveying unit, a rotating motion of a clamp moving motor 101 is transmitted by a driving belt 102, and is converted into a vertical motion by a vertical conveying belt 104*a* stretched across a lower driving pulley 103 and an upper driving pulley 105, and a vertical conveying belt 104*b* stretched on a side of the apparatus opposite to the vertical conveying belt 104*a*.

A clamp vertical moving member 107*a* is attached to the vertical conveying belt 104*a*, and is supported by a shaft 106*a* so as to be vertically moved. A clamp lateral moving member 108*a* is attached to the clamp vertical moving member 107*a* to enable lateral movement.

A clamp vertical moving member 107*b* is attached to the vertical conveying belt 104*b*, and is supported by a shaft 106*b* so as to be vertically moved. A clamp lateral moving member 108*b* is attached to the clamp vertical moving member 107*b* to enable the lateral movement.

A clamp stay 114 is connected to each of the clamp lateral moving members 108*a* and 108*b*, and these clamp stays 114 move in the direction of the arrow Q along side plate rails 110*a* and 110*b* of side plates 109*a* and 109*b*, in association with the vertical movement of the vertical conveying belts 104*a* and 104*b*.

The sheet P having the trailing edge thereof clamped by the clamping unit R, which corresponds to the portion R represented by a dotted line in FIG. 3, is conveyed through a conveying path formed by conveying guide plates 111*a*, 111*b*, 112*a*, 112*b*, 113, 115, 116, and 117. The sheet P is then detected by a folding position sensor 118 arranged on the conveying guide plate 116, and is stopped being conveyed at the predetermined position.

Figure 4:
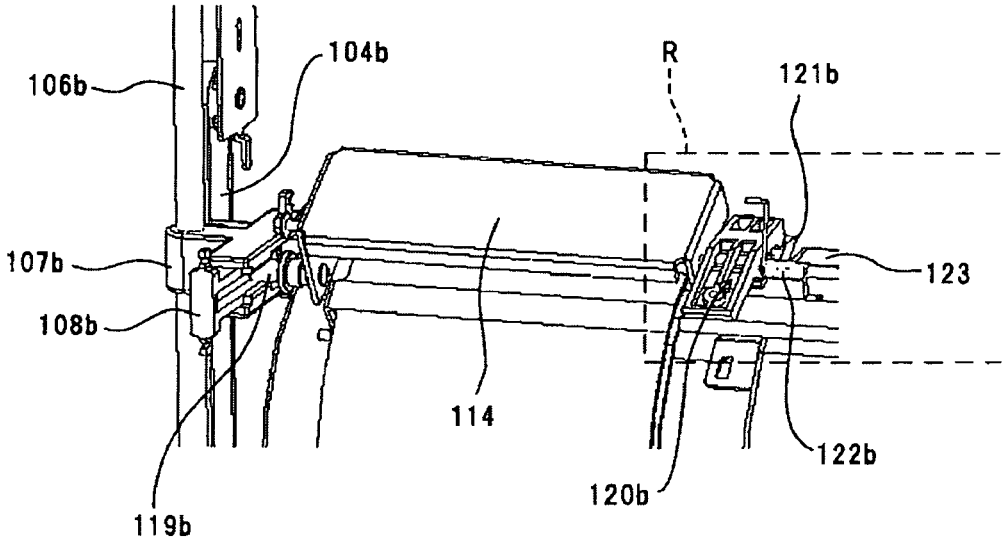
FIG. 4 is an enlarged view of a clamping unit.

FIG. 4 is an enlarged view of the portion H represented by a dotted line in FIG. 3.

The clamp lateral moving member 108*b* is arranged in the clamp vertical moving member 107*b* to be swingable in the lateral directions, and a clamp stay shaft 119*b* provided in the clamp lateral moving member 108*b* is inserted in a shaft bearing portion on the clamp stay 114. In this manner, the clamp stay 114 is made movable in the vertical directions in association with vertical movement of the clamp vertical moving member 107*b*, as well as in the lateral directions following the side plate rail 110*b* (see FIG. 3) in association with the lateral movement of the clamp lateral moving member 108*b*.

A lower clamp 121*b* is arranged in a manner fixed to the clamp stay 114. The structure on a side of the clamp vertical moving member 107*a* is the same. Therefore, the explanation thereof is omitted herein.

Figure 5:
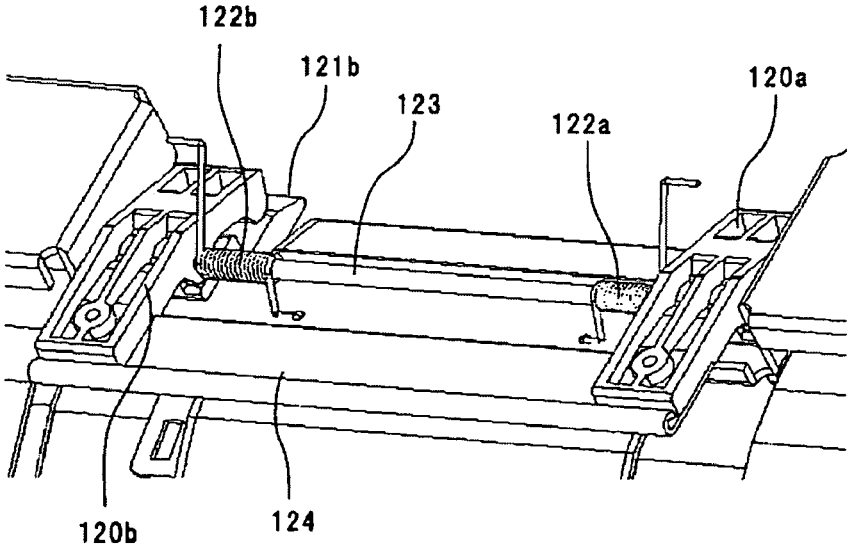
FIG. 5 is another enlarged view of the clamping unit.
Figure 6:
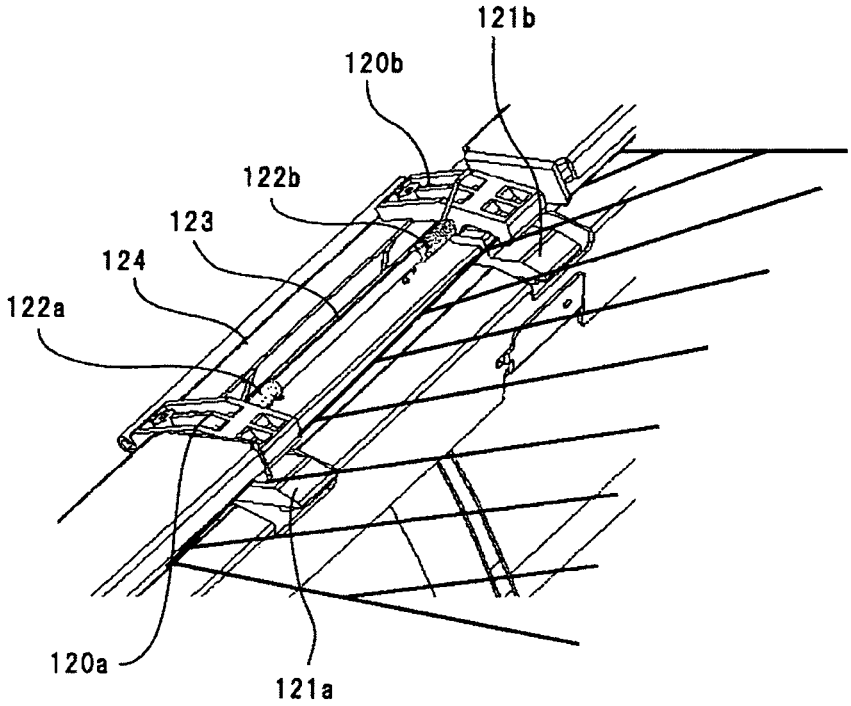
FIG. 6 is still another enlarged view of the clamping unit.

FIG. 5 is an enlarged view of the clamping unit R that is the portion R denoted by a dotted line in FIGS. 3 and 4, illustrating the clamping unit R nipping the trailing edge of the sheet P. FIG. 6 is a schematic of the clamping unit R illustrated in FIG. 5 seen from a different angle, depicting the clamping unit R clamping the trailing edge of the sheet P between upper clamps 120*a* and 120*b* and lower clamps 121*a* and 121*b*.

In the clamping unit R of the clamped bundle conveying unit, the upper clamps 120*a* and 120*b* and the lower clamps 121*a* and 121*b* are connected to a clamp shaft 123 provided on the clamp stay 114. The upper clamps 120*a* and 120*b* are arranged in a rotatable manner about the clamp shaft 123, and the lower clamps 121*a* and 121*b* are arranged in a fixed manner. The upper clamps 120*a* and 120*b* are pressed against the lower clamps 121*a* and 121*b*, respectively, by spring force of springs 122*a* and 122*b*, in which the clamp shaft 123 serves as a rotation axis. The upper clamp 120*a* and the upper clamp 120*b* are connected to each other via a clamp connecting metal plate member 124, and the upper clamp 120*a* and the upper clamp 120*b* move simultaneously. The upper clamps 120*a* and 120*b* and the lower clamps 121*a* and 121*b* clamp the trailing edge of the sheet P therebetween using the spring force of the springs 122*a* and 122*b*.

The sheet P bound at the center and clamped by the clamping unit R is conveyed in a downward direction by the clamped bundle conveying unit along the conveying path 4, and is stopped being conveyed when the center of the sheet in the length direction reaches a position of a folding blade 203 included in the conveying path 4, and the process goes onto a folding process. The position at which the sheet P is stopped is determined based on transmission of a predetermined number of pulses after the bottom edge of the sheet P in the conveying path 4 is detected by the folding position sensor 118.

Figure 7:
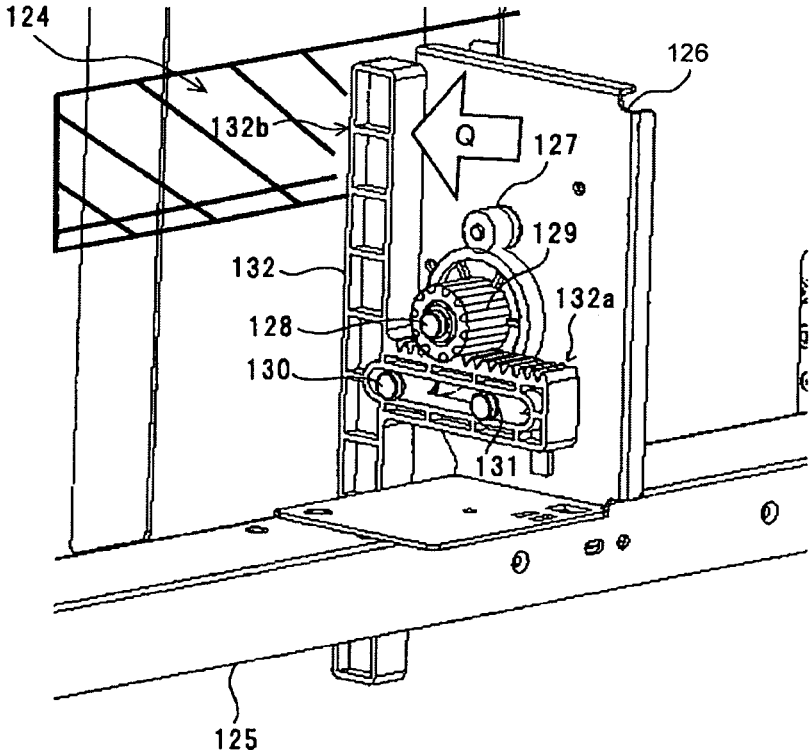
FIG. 7 is an enlarged view of a clamp releasing mechanism.
Figure 8:
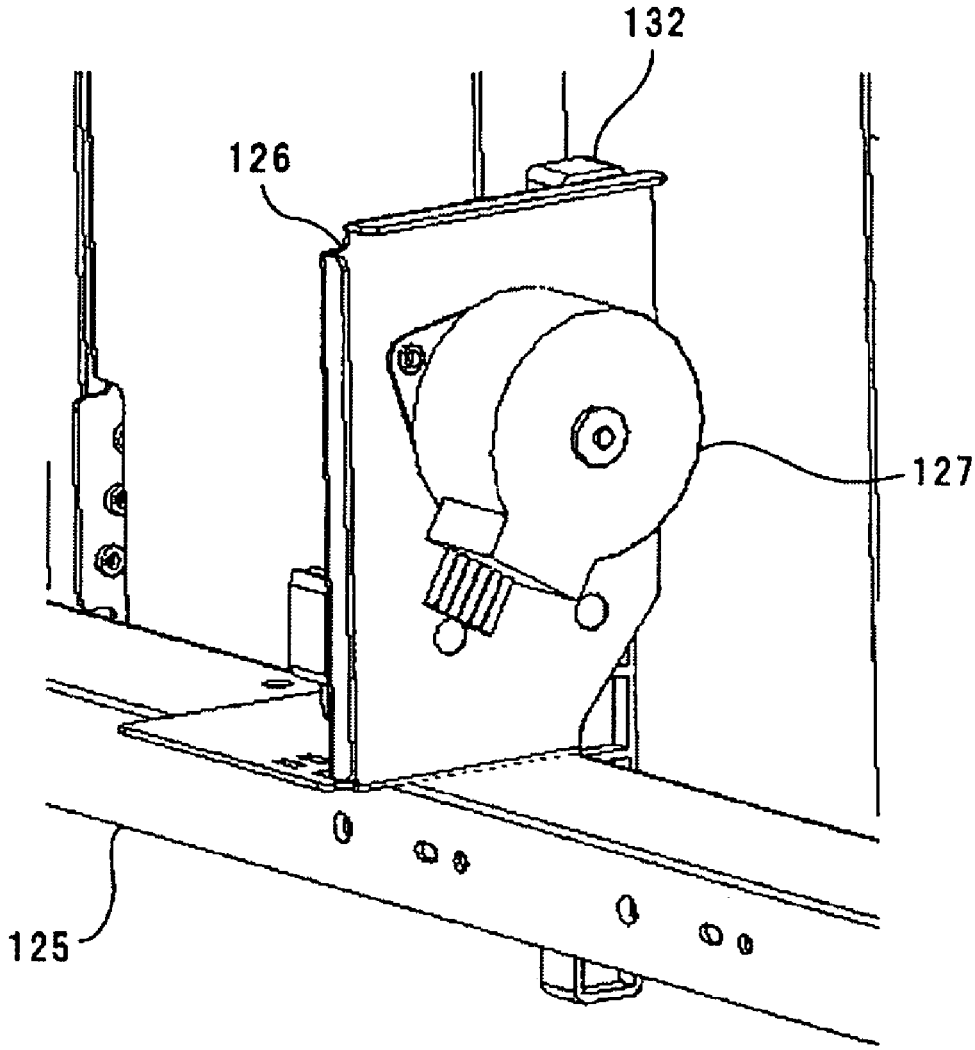
FIG. 8 is another enlarged view of the clamp releasing mechanism.

FIGS. 7 and 8 are enlarged views of the portion V denoted by a dotted line in FIG. 3, illustrating a clamp releasing mechanism configured to release clamping of the clamping unit R clamping the trailing edge of the sheet P.

The clamp releasing mechanism is driven by a clamp releasing motor 127 attached to a clamp releasing motor bracket 126 fixed to a stay 125. The driving force of the clamp releasing motor 127 is transmitted to a rack 132*a* provided on a clamp releasing lever 132 having shafts 130 and 131 as lateral axes via a gear 129 having a shaft 128 as an axis. When the clamp releasing lever 132 is moved in the direction of the arrow Q in FIG. 7, a pressing portion 132*b* of the clamp releasing lever 132 presses the clamp connecting metal plate member 124, and the upper clamps 120*a* and 120*b* are rotated against the spring force of the springs 122*a* and 122*b*. As a result, the upper clamps 120*a* and 120*b* open with respect to the sheet P clamped between the upper clamps 120*a* and 120*b* and the lower clamps 121*a* and 121*b*, releasing the clamping unit R clamping the sheet P. In this manner, at the time of the folding process after the sheet is conveyed, the sheet P clamped by the clamping unit R is thus released so as to be ready for press-folding.

Figure 9:
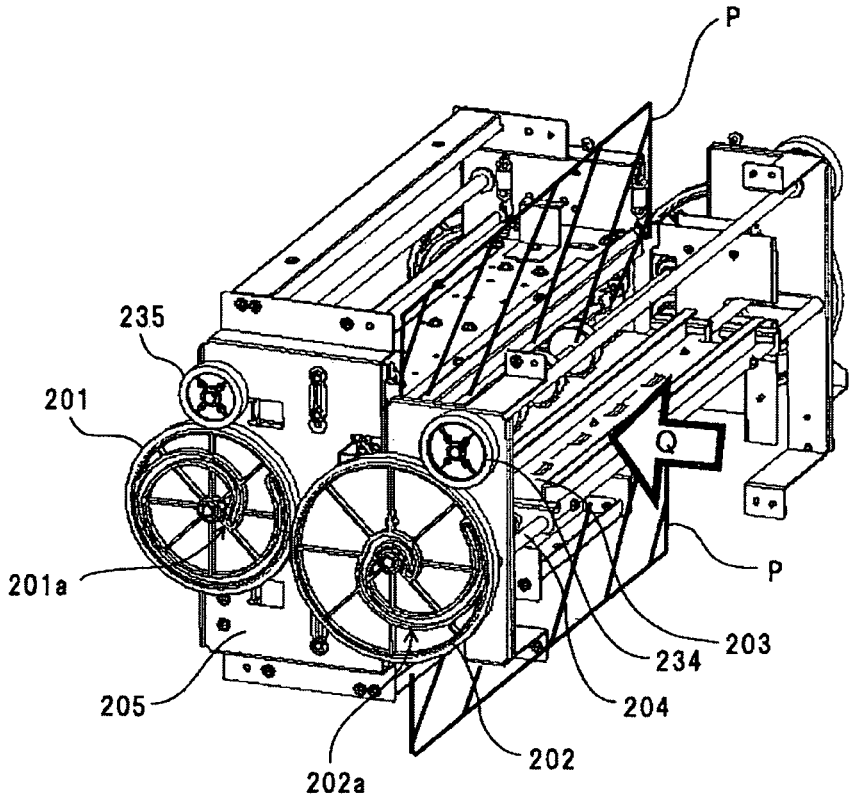
FIG. 9 is a perspective view of a structure of the press-folding unit.
Figure 10:
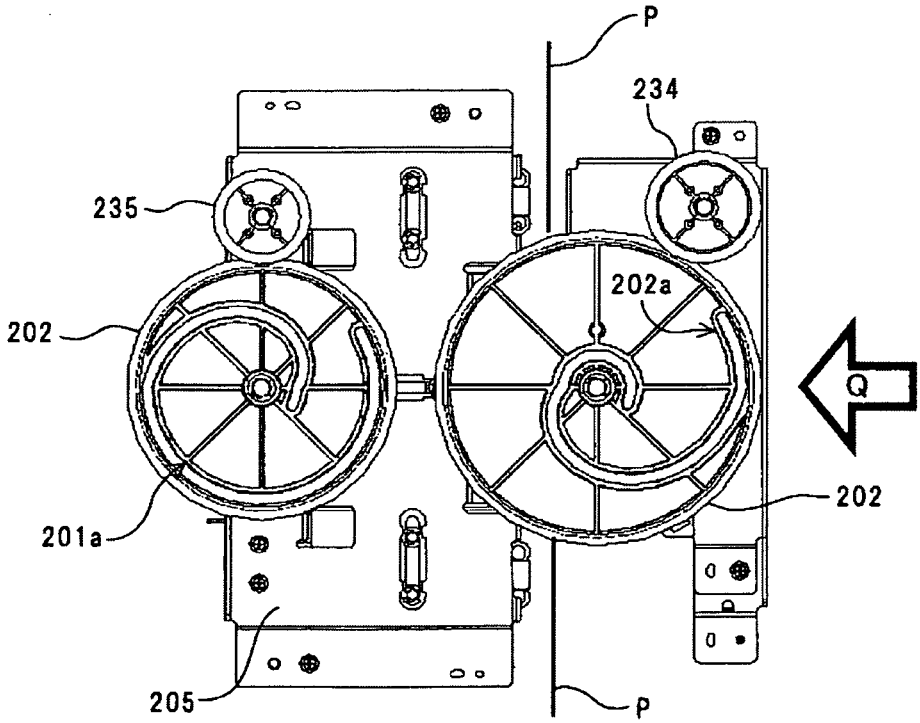
FIG. 10 is a side view of the press-folding unit.

FIG. 9 is a perspective view of the press-folding unit, and FIG. 10 is a side view of the press-folding unit.

The press-folding unit includes a pressing board driving cam 201, a folding blade driving cam 202, a folding blade 203, a folding blade supporting rod 204, and a side plate 205.

When the folding blade driving cam 202 is rotated, the folding blade supporting rod 204 is moved horizontally by virtue of a cam groove 202*a*, moving the folding blade 203 in the direction of the arrow Q in FIGS. 9 and 10 to guide a center of the sheet P in its length direction into a folding unit.

A pressing unit configured to fold the sheet P guided into the folding unit by the folding blade 203 will now be explained.

Figure 11:
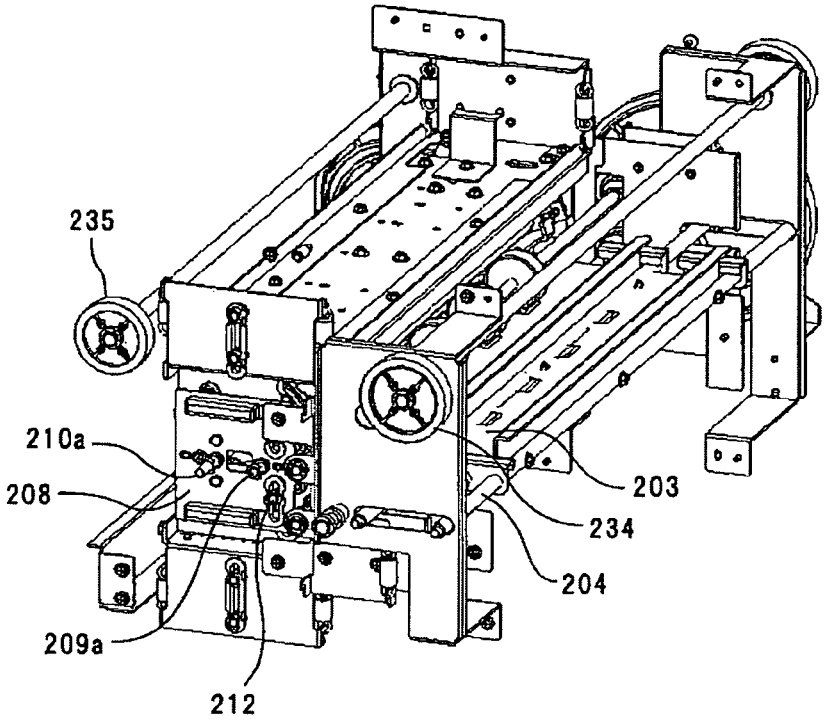
FIG. 11 is a perspective view of a structure of the press-folding unit.
Figure 12:
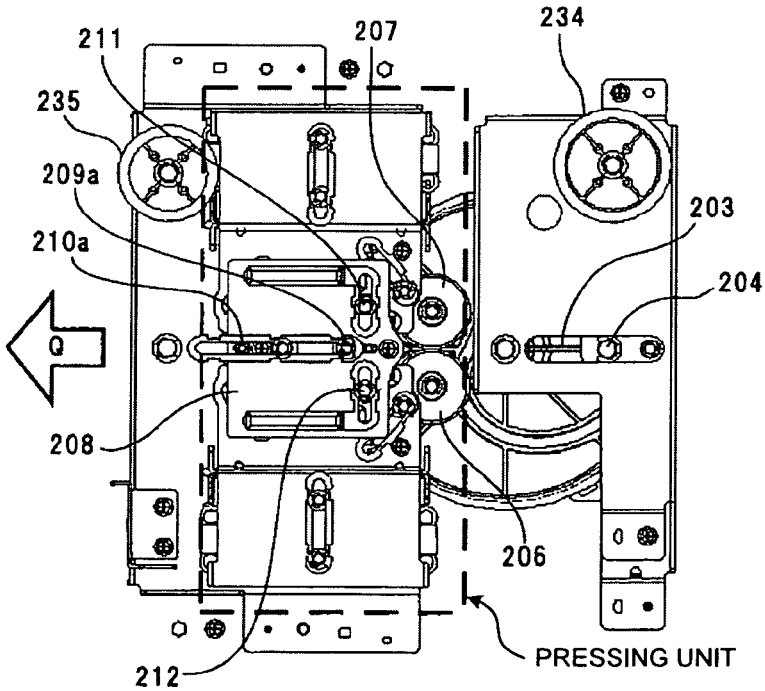
FIG. 12 is a side view of the press-folding unit.

FIG. 11 is a schematic of a structure of the press-folding unit in which the pressing board driving cam 201, the folding blade driving cam 202, and the side plate 205 are removed from FIG. 9. FIG. 12 is a side view of the press-folding unit illustrated in FIG. 11.

The pressing unit denoted by a dotted line in FIG. 12 includes conveying rollers 206 and 207, a moving plate 208, press guiding rollers 211 and 212, and pressure releasing members 209 and 210.

The conveying roller 206 and the conveying roller 207 nip and convey a end portion to be folded of the sheet P guided into the folding unit by the folding blade 203 to the pressing unit. The moving plate 208 is configured to move in the direction of the arrow Q in FIG. 12 and the direction opposite thereto so as to move left and right the press guiding rollers 211 and 212 and the pressure releasing members 209 and 210 connected to the moving plate 208.

Figure 1:
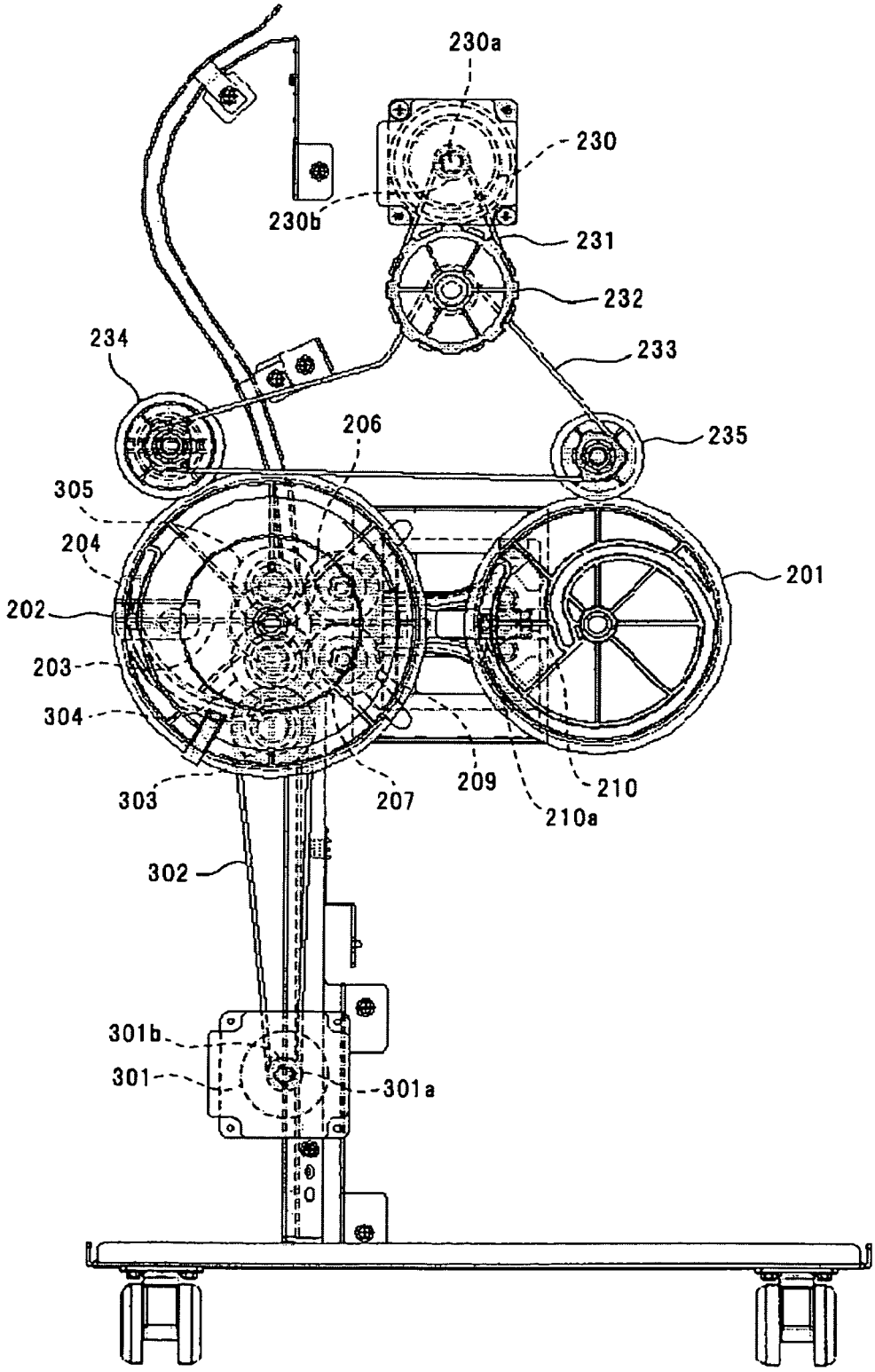
FIG. 1 is a schematic of a driving mechanism for a press-folding unit.

FIG. 1 is a schematic for explaining a driving mechanism for the pressing board driving cam 201 and the folding blade driving cam 202.

When a folding driving motor 230 is rotated, the driving force of a rotating shaft 230*a* of the folding driving motor 230 is transmitted to a folding driving motor timing belt 231 via a pulley 230*b*. The driving force transmitted to the folding driving motor timing belt 231 is transmitted from a folding driving pulley 232 to a folding blade driving gear 234 via a folding driving unit timing belt 233. The driving force transmitted to the folding driving motor timing belt 231 is also transmitted from the folding driving pulley 232 to a pressing board driving gear 235 via the folding driving unit timing belt 233. The driving force is then transmitted from the folding blade driving gear 234 to the folding blade driving cam 202, and drives the folding blade driving cam 202 in rotation. The driving force is also transmitted from the pressing board driving gear 235 to the pressing board driving cam 201, and drives the pressing board driving cam 201 in rotation.

As the folding blade driving cam 202 is rotated, the folding blade supporting rod 204 formed integrally with the folding blade 203 is moved along the spiral groove 202*a* on the folding blade driving cam 202 so that the folding blade 203 can move in the horizontal directions.

As the pressing board driving cam 201 is rotated, a shaft 209*a* formed integrally with the pressure releasing member 209 is moved along a spiral groove 201*a* of the pressing board driving cam 201, moving the pressure releasing member 209 in the horizontal directions.

A driving motor 301 that is a driving source used to drive the conveying roller 206 and the; conveying roller 207 in rotation is disposed under the folding blade driving cam 202, and the driving force is transmitted from the driving motor 301 to the conveying roller 206 and the conveying roller 207 via a drive transmitting mechanism. In other words, when the driving motor 301 is rotated, the driving force of a rotating shaft 301*a* of the driving motor 301 is transmitted to a driving motor timing belt 302 via a pulley 301*b*. The driving force transmitted to the driving motor timing belt 302 is further transmitted to a driving gear 304 via a pulley 303. The driving force transmitted to the driving gear 304 is transmitted to the conveying roller 207, and also to a driving gear 305. The driving force transmitted to the driving gear 305 is further transmitted to the conveying roller 206. In this manner, the driving force is transmitted to the conveying roller 206 and to the conveying roller 207 so that the end portion to be folded of the sheet P guided into the folding unit by the folding blade 203 is nipped between and conveyed by the conveying roller 206 and the conveying roller 207 into the pressing unit.

Figure 13:
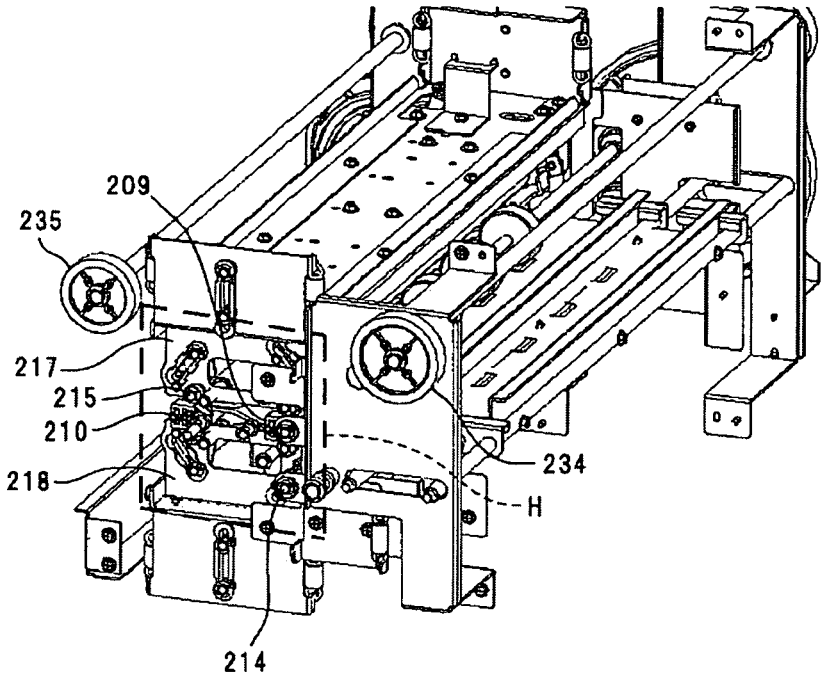
FIG. 13 is a schematic of the press-folding unit in which a moving plate is removed from FIG. 11.
Figure 14:
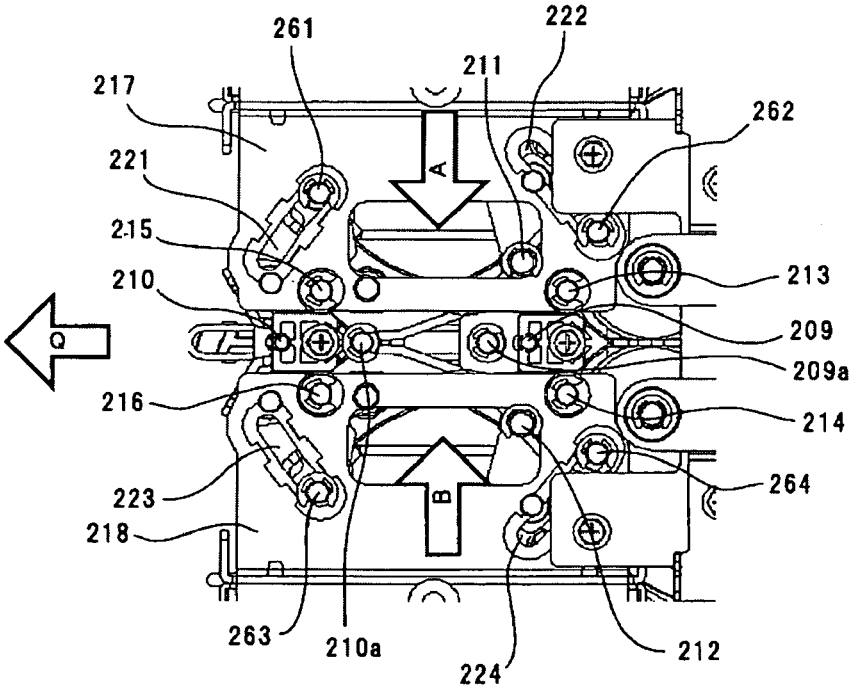
FIG. 14 is an enlarged view of FIG. 13.
Figure 15:
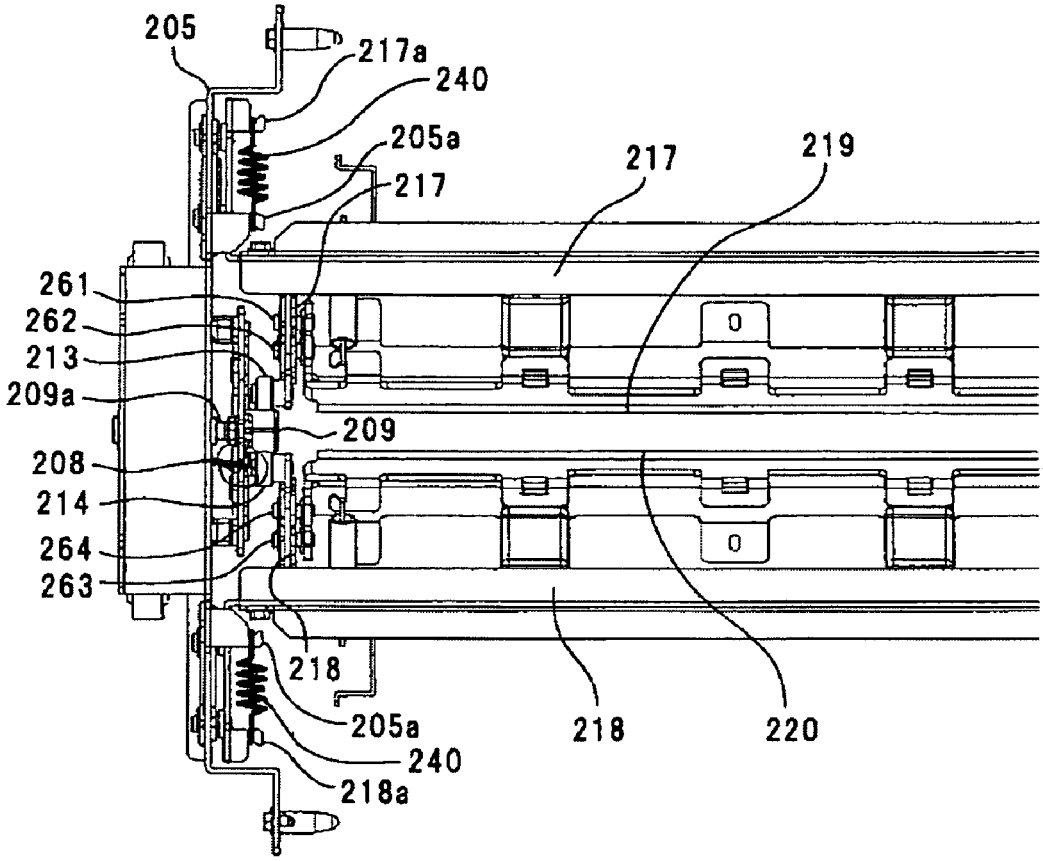
FIG. 15 is a schematic of a structure in which pressure is applied using pressing members included in the pressing units.

FIG. 13 is a perspective view of the pressing unit in which the moving plate 208 is removed from FIG. 11. FIG. 14 is an enlarged side view of the portion H of the pressing unit denoted by the dotted line in FIG. 13. FIG. 15 is a schematic for explaining the structure configured to apply pressure between an upper pressing unit 217 and a lower pressing unit 218.

As illustrated in FIG. 15, respective ends of a pressure applying spring 240 are hooked onto a hook 205*a* provided on the side plate 205 and a hook 217*a* provided on the upper pressing unit 217. The hook 205*a* of the side plate 205 and the hook 217*a* of the upper pressing unit 217 are pulled by the pressure applying spring 240, applying downward pressure to the upper pressing unit 217 (in the direction from the upper pressing unit 217 toward the lower pressing unit 218).

Respective ends of another pressure applying spring 240 are hooked onto another hook 205*a* provided on the side plate 205 and a hook 218*a* provided on the lower pressing unit 218. The hook 205*a* of the side plate 205 and a hook 21*a* of the lower pressing unit 218 are pulled by the pressure applying spring 240, applying upward pressure toward the lower pressing unit 218 (in the direction from the lower pressing unit 218 to the upper pressing unit 217).

The upper pressing unit 217 and the lower pressing unit 218 are pulled by the pressure applying springs 240 so that a pressing board 219 provided on the upper pressing unit 217 applies pressure to a pressing board 220 provided on the lower pressing unit 218, and vice versa. Although not illustrated, the pressure applying springs 240 are arranged at four corners of the upper pressing unit 217 and the lower pressing unit 218, so that the upper pressing unit 217 and the lower pressing unit 218 are applied with pressure by eight pressure applying springs 240 in total.

In a standby condition, the upper pressing unit 217 and the lower pressing unit 218 are kept separated by the pressure releasing members 209 and 210 arranged inside of the moving plate 208. This condition is reached when the end portion to be folded of the sheet P is received.

When the moving plate 208 is moved in the direction of the arrow Q, the pressure releasing members 209 and 210 connected to the moving plate 208 are moved in the direction of the arrow Q in association with the movement of the moving plate 208, causing rollers 213 and 215 of the upper pressing unit 217 to move in the direction of the arrow A (the downward direction) in FIG. 14, and causing rollers 214 and 216 of the lower pressing unit 218 to move in the direction of the arrow B (the upward direction) following the respective sloped surfaces of the pressure releasing members 209 and 210. As a result, the pressing board 219 is caused to move in the direction of the arrow A (the downward direction) in FIG. 14, and the pressing board 220 is caused to move in the direction of the arrow B (the upward direction) in FIG. 14. The end portion to be folded of the sheet P is then nipped between and pressed by a side surface of the pressing board 219 and a side surface of the pressing board 220. By nipping and pressing to fold the sheet P between the side surface of the pressing board 219 and the side surface of the pressing board 220, the sheet P can be folded without deformation or positioning errors accumulated in the sheet P, and without wrinkling or damage of the sheet P. Furthermore, the pressing boards 219 and 220 can be manufactured more easily than folding rollers that have been conventional used. Therefore, costs of parts can be reduced, and folding can be performed using a less expensive structure. Furthermore, by using the pressing boards 219 and 220, the weight and the size of the apparatus can be reduced comparing with an apparatus using the folding rollers.

Figure 16:
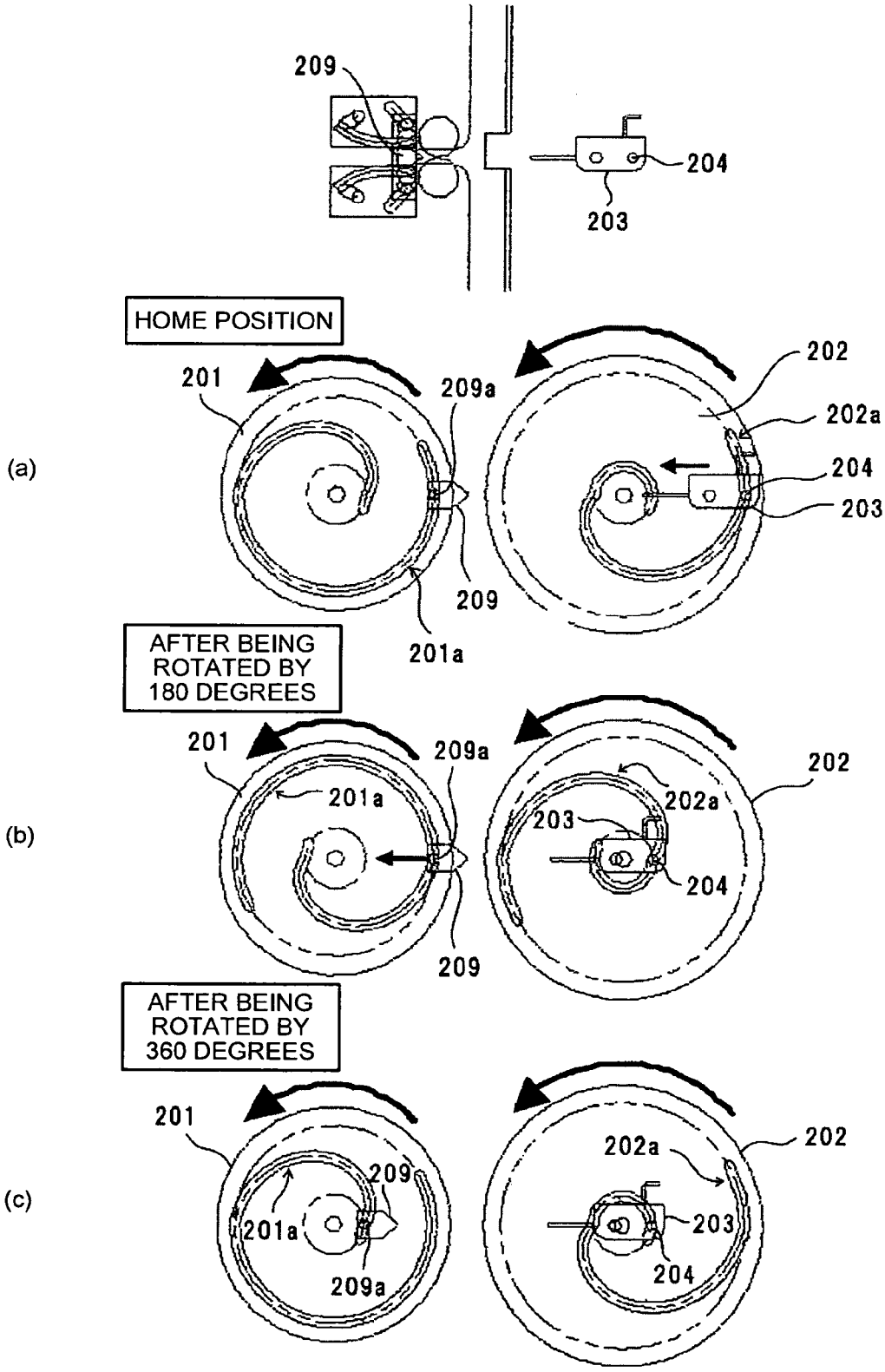
FIG. 16 is a schematic of operations of a folding blade and a pressure releasing member.

FIG. 16 is a schematic of operations of the folding blade driving cam 202 and the pressing board driving cam 201, an operation of the folding blade 203 being caused to move in association with the folding blade driving cam 202, and an operation of the pressure releasing member 209 being caused to move in association with the pressing board driving cam 201 when the folding driving motor 230 is rotated clockwise when viewed from the axial direction as in FIG. 1.

When the folding driving motor 230 is rotated clockwise when viewed from the axial direction as in FIG. 1, the folding blade driving cam 202 and the pressing board driving cam 201 positioned at home positions illustrated at (a) in FIG. 16 are rotated counterclockwise. While the folding blade driving cam 202 and the pressing board driving cam 201 are rotated from home positions (0 degree) illustrated at (a) in FIG. 16 to positions after rotated by 180 degrees illustrated at (b) in FIG. 16, the folding blade supporting rod 204 is moved along the spiral groove 202*a* of the folding blade driving cam 202, moving the folding blade 203 horizontally left in FIG. 16A but the pressure releasing member 209 is kept approximately at the same position without moving horizontally. While the folding blade driving cam 202 and the pressing board driving cam 201 are rotated further from the positions after rotated by 180 degrees illustrated at (b) in FIG. 16 to positions after rotated by 360 degrees illustrated at (c) in FIG. 16, the folding blade 203 stays at approximately the same position without moving horizontally but the shaft 209*a* is moved along the spiral groove 201*a* of the pressing board driving cam 201, moving the pressure releasing member 209 horizontally left in FIG. 16B. Because the pressure releasing member 209 is moved horizontally in this manner, the moving plate 208 on which the shaft 209*a* of the pressure releasing member 209 is attached is moved horizontally in the same direction, and the pressure releasing member 210 having a shaft 210*a* attached to the moving plate 208 is also moved horizontally in the same direction as the pressure releasing member 209.

In this manner, the spiral groove 202*a* of the folding blade driving cam 202 and the spiral groove 201*a* of the pressing board driving cam 201 have structures to cause the folding blade 203 and the pressure releasing members 209 and 210 to move at different operational timings. As a result, the sheet P is guided into the folding unit using the folding blade 203 to begin with. The pressure releasing members 209 and 210 are then moved so as to cause the pressing boards 219 and 220 to apply pressures to fold the sheet P.

When the folding driving motor 230 is rotated counterclockwise when viewed from the axial direction as in FIG. 1 after the folding operation is completed, the pressure releasing member 209 is moved horizontally right in FIG. 16 while the folding blade driving cam 202 and the pressing board driving cam 201 move from the positions after rotated by 360 degrees to the positions after rotated by 180 degrees. As a result, the upper pressing unit 217 and the lower pressing unit 218 are opened, while the folding blade 203 is kept at the same position without moving horizontally. After that, while the folding blade driving cam 202 and the pressing board driving cam 201 rotate from the positions after rotated by 180 degrees to the home positions (0 degree), the pressure releasing member 209 stays approximately at the same position without moving horizontally, and the folding blade 203 is moved horizontally right in FIG. 16 and returns to the home position.

In this manner, by rotating the folding driving motor 230 clockwise or counterclockwise, the operational timing at which the sheet P is guided into the folding unit by the folding blade 203 can be shifted from the operational timing at which pressure is applied to the sheet P by the pressing boards 219 and 220. Therefore, a folding operation, an operation of releasing pressure between the pressing boards 219 and 220, and an operation of retracting the folding blade 203 can be achieved by simple control.

Furthermore, because the operational timing at which the folding blade 203 operates and the operational timings at which the pressing boards 219 and 220 operate are different from each other, the folding driving motor 230 can be prevented from being applied with a large driving load that could be applied if the folding blade 203 and the pressing boards 219 and 220 are to be operated simultaneously. Therefore, the size and the force of the folding driving motor 230 can be reduced, and the space occupied by and the cost of the sheet post-processing apparatus 100 can be saved.

Figure 17:
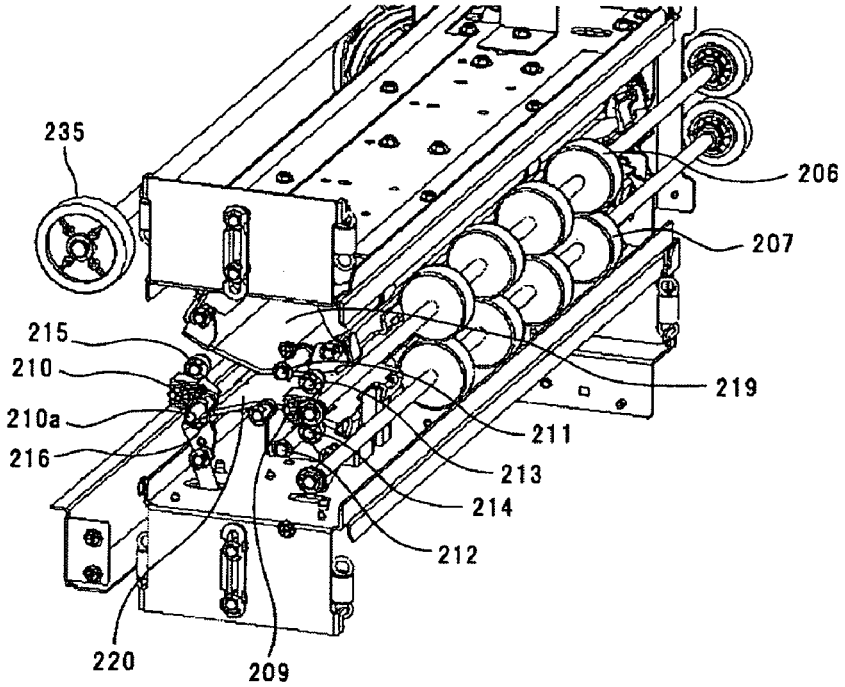
FIG. 17 is a schematic of the inside of the press-folding unit.
Figure 18:
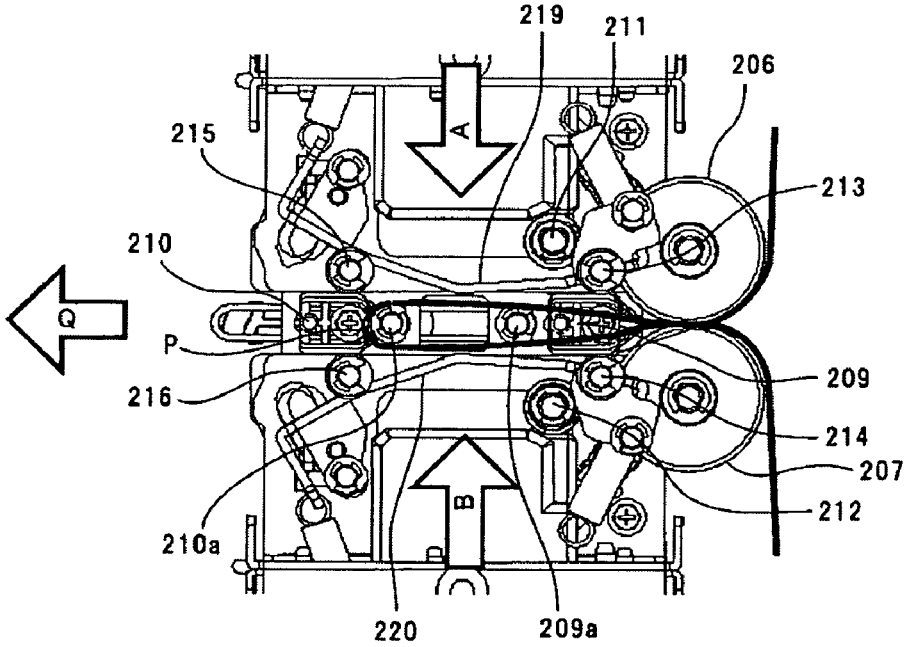
FIG. 18 is a side view of the inside of the press-folding unit.

FIG. 17 is a schematic of the inside of the press-folding unit illustrated in FIG. 12. FIG. 18 is a side view of the press-folding unit illustrated in FIG. 17.

The pressing boards 219 and 220 are connected inside of the press-folding unit. In order to cause the sheet P to be nipped between the pressing board 219 and the pressing board 220 to fold the sheet P, the pressing board 219 is moved in the direction of the arrow A in FIG. 18 and the pressing board 220 is moved in the direction of the arrow B in FIG. 18 in association with movement of the pressure releasing members 209 and 210.

The press guiding rollers 211 and 212 are connected to the moving plate 208 as illustrated in FIG. 12, and thus respectively move, above the pressing boards 219 and 220, in association with the movement of the moving plate 208 in the direction of the arrow Q. As a result, folding of the sheet P proceeds toward the end portion to be folded thereof by the curved forms of the pressing boards 219 and 220 that are made rotatable by virtue of rollers 261 and 262 attached to corners on an end of the pressing board 219 in its longitudinal direction and respectively engaged into grooves 221 and 222 illustrated in FIG. 14 formed on a side of the upper pressing unit 217 so as to move along the grooves 221 and 222, and by virtue of rollers 263 and 264 attached to corners on an end of the pressing board 220 in its longitudinal direction and movably engaged into grooves 223 and 224 illustrated in FIG. 14 formed on the side of the lower pressing unit 218 so as to move along the grooves 223 and 224.

FIGS. 19A to 19D are schematics of a sequence of pressing operations performed to fold a sheet bundle.

Figure 19A:
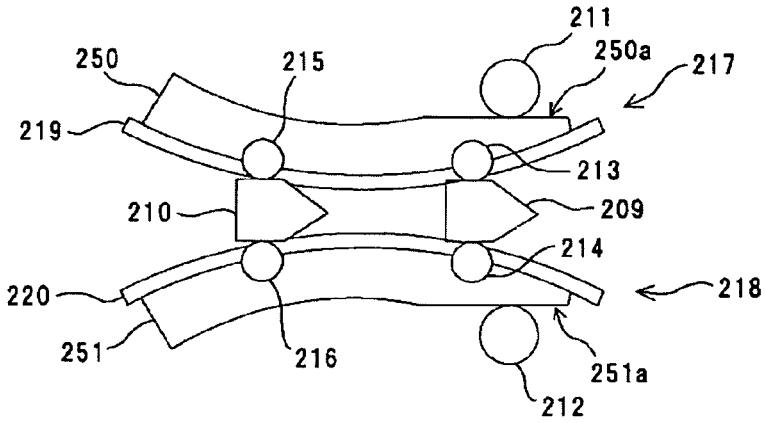
FIGS. 19A to 19D are schematics of a sequence of pressing operations applied to a sheet bundle.

In a press-waiting condition illustrated in FIG. 19A, the pressure releasing member 209 is kept inserted between the roller 213 of the upper pressing unit 217 and the roller 214 of the lower pressing unit 218, and the pressure releasing member 210 is kept inserted between the roller 215 of the upper pressing unit 217 and the roller 216 of the lower pressing unit 218.

Figure 19B:
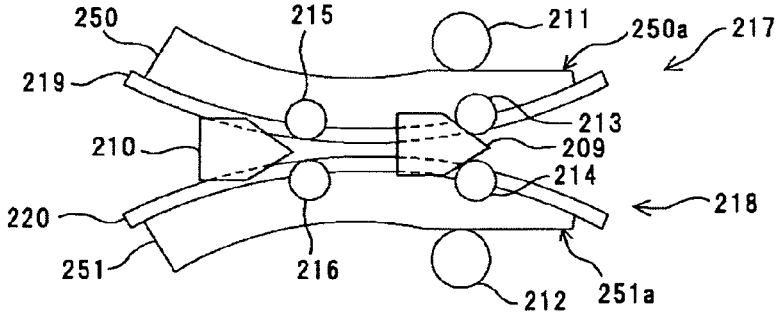

The movement of the moving plate 208 (see FIG. 12) in the direction of the arrow Q in FIG. 12 causes the pressure releasing members 209 and 210 and the press guiding rollers 211 and 212 to move left in FIG. 19B.

As the pressure releasing member 209 is moved away from the roller 213 of the upper pressing unit 217 and the roller 214 of the lower pressing unit 218, and as the pressure releasing member 210 is moved away from the roller 215 of the upper pressing unit 217 and the roller 216 of the lower pressing unit 218, the upper pressing unit 217 and the lower pressing unit 218 move closer to each other as illustrated in FIG. 19B.

Figure 19C:
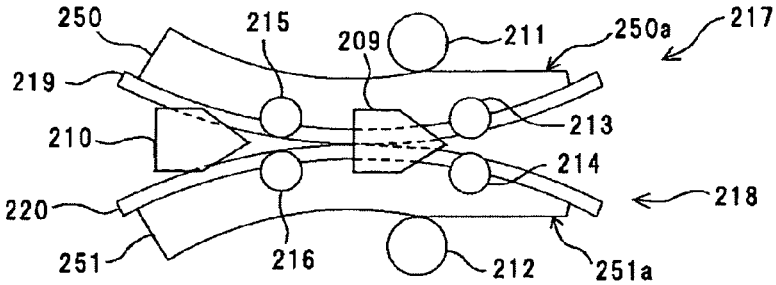

Then, as illustrated in FIG. 19C, as the pressure releasing member 209 is completely moved away from the roller 213 of the upper pressing unit 217 and the roller 214 of the lower pressing unit 218, and as the pressure releasing member 210 is completely moved away from the roller 215 of the upper pressing unit 217 and the roller 216 of the lower pressing unit 218, the pressing board 219 provided on the upper pressing unit 217 is brought into partial contact with the pressing board 220 provided on the lower pressing unit 218, applying pressure to the sheet bundle nipped between the pressing board 219 and the pressing board 220 in a vertical direction.

Because of the presence of horizontal portions 250*a* and 251*a* formed respectively on guiding members 250 and 251 of the pressing boards 219 and 220, the pressing boards 219 and 220 are applied with the loads by the press guiding rollers 211 and 212 only in the vertical directions until a condition illustrated in FIG. 19C is reached. Therefore, the orientations of the pressing boards 219 and 220 are kept unchanged.

Figure 19D:
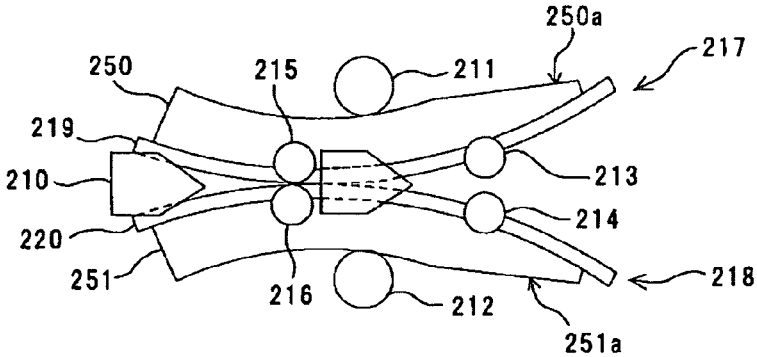

When the moving plate 208 (see FIG. 12) is further moved in the direction of the arrow Q in FIG. 12, the pressing boards 219 and 220 roll on one another as illustrated in FIG. 19D, folding proceeds towards the end portion to be folded of the sheet bundle, because the guiding members 250 and 251 of the pressing boards 219 and 220 have the same forms as the pressing boards 219 and 220, respectively.

In this manner, by pressing a center of the sheet bundle in its length direction, which is guided into the press-folding unit, using the pressing boards 219 and 220 in the vertical directions, the sheet bundle is folded at the center. The sheet P folded at the center is discharged by the conveying rollers 206 and 207 and a discharging roller 58 illustrated in FIG. 2 onto a saddle stitch folding tray 62.

The sheet P discharged onto the saddle stitch folding tray 62 is held down by a sheet holding roller 61 attached to a sheet holding member 60 to realize a mechanism that prevents the folded sheet P from bulging out and interfering with discharge of the next sheet.

In the embodiment, the sheet punching unit 200 and a center folding unit 300 including the conveying path 4 are configured to be removable so that the sheet post-processing apparatus 100 having minimum components satisfying needs of users can be provided.

According to the embodiment, the sheet folding apparatus includes the folding blade 203 that is a blade member having an edge configured to push the surface of a sheet to push the sheet into the sheet folding unit that applies folding to the sheet, the pressing boards 219 and 220 that are a pair of nipping members that are included in the sheet folding unit and nip the sheet pushed into the sheet folding unit by the folding blade 203, a blade member moving unit that includes the folding blade driving cam 202 and that moves the folding blade 203 between a pushing position where the folding blade 203 pushes the sheet into the sheet folding unit and a position retracted from the pushing position, and a nipping member moving unit that includes the pressing board driving cam 201 and the pressure releasing members 209 and 210 and that moves the pressing boards 219 and 220 between a nipping position where the pressing boards 219 and 220 nip the sheet and a position retracted from the nipping position. The sheet folding apparatus folds the sheet by being nipped between the pressing boards 219 and 220. The blade member moving unit and the nipping member moving unit are driven by the same driving unit that is the folding driving motor 230. In this manner, the cost and the size of the apparatus can be reduced because a number of driving motors can be reduced compared with a structure in which the blade member moving unit and the nipping member moving unit are driven by different driving motors.

Furthermore, according to the embodiment, the pressing boards 219 and 220 are a pair of board-like members having respective side surfaces arranged in a manner facing each other so as to nip the sheet therebetween. In the embodiment, because the sheet folding apparatus has a structure configured to fold the sheet P by applying pressure to the sheet P with the side surfaces of the pressing boards 219 and 220 while keeping the sheet P stopped. Therefore, the sheet P can be folded without deformation or positioning errors accumulated in the sheet P, and without wrinkling or damage of the sheet P. The pressing boards 219 and 220 can be manufactured more easily than a folding roller that has conventionally used. Therefore, costs of parts can be reduced, and folding can be performed using a less expensive structure. Furthermore, by using the pressing boards 219 and 220, weight and size of the apparatus can be reduced compared with an apparatus using the folding roller.

Furthermore, the embodiment employs a configuration in which the operation of moving the folding blade 203 performed by the blade member moving unit can be performed in association with the operation of moving the pressing boards 219 and 220 performed by the nipping member moving unit by causing the folding driving motor 230 to operate. Therefore, the control related to the operation of folding the sheet P can be simplified.

Furthermore, according to the embodiment, the operational timing at which the blade member moving unit moves the folding blade 203 is different from the operational timing at which the nipping member moving unit moves the pressing boards 219 and 220. Therefore, when the folding driving motor 230 is operated, the folding blade 203 is at first caused to move to guide a portion to be folded of the sheet P into the folding unit and the pressing operation of the sheet P performed by the pressing boards 219 and 220 is then started. Consequently, a folding process where the operational timing of guiding the sheet P into the folding unit using the folding blade 203 is different from the operational timing of applying pressure to the sheet using the pressing boards 219 and 220 can be realized by operation of the single folding driving motor 230 and thus the control related to the folding operation of the sheet P can be simplified. Furthermore, because the operational timings of operating the folding blade 203 and the pressing boards 219 and 220, which are the driving loads of the driving roller 230, are differentiated, it is possible to prevent a large driving load from being applied simultaneously to the driving roller 230. Therefore, an inexpensive small-sized or low-powered motor can be used as the folding driving motor 230. Thus, the space occupied by and the cost of the apparatus can be reduced.

Furthermore, according to the embodiment, a direction of movement of the folding blade 203 between the pushing position and the position retracted from the pushing position, and a direction of movement of the pressing boards 219 and 220 between the nipping position and the position escaped from the nipping position are switched by switching driving direction by the folding driving motor 230. Therefore, forwarding and retracting operations of the folding blade 203 toward and from the folding unit and pressing and pressure releasing operations of the pressing boards 219 and 220 can be achieved only by switching the direction of driving of the blade member moving unit and the nipping member moving unit by the folding driving motor 230. Therefore, a folding operation can be performed with simple control.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet folding apparatus comprising:

a blade member including an edge configured to push a surface of a sheet so as to push the sheet into a sheet folding unit configured to fold the sheet;

a pair of nipping members included in the sheet folding unit, to nip the sheet pushed into the sheet folding unit by the blade member;

a blade member moving unit configured to move the blade member between a pushing position where the blade member pushes the sheet into the sheet folding unit and a position retracted from the pushing position;

a pressure releasing member configured to be inserted between the pair of nipping members and to be moved away from between the pair of nipping members, the pressure releasing member configured to separate the pair of nipping members if inserted between the pair of nipping members and configured to move the pair of nipping members closer to each other if the pressure releasing member is moved away from between the pair of nipping members; and a nipping member moving unit configured to move the pair of nipping members between a nipping position where the pair of nipping members nip the sheet and a position retracted from the nipping position, the sheet folding apparatus being configured to fold the sheet by nipping the sheet between the pair of nipping members, and the blade member moving unit and the nipping member moving unit being driven by a shared driving unit.

2. The sheet folding apparatus according to claim 1, wherein the pair of nipping members are a pair of board-like members having respective side surfaces arranged in a manner facing each other, and the sheet is nipped between the side surfaces of the pair of board-like members.

3. The sheet folding apparatus according to claim 1, wherein an operation of moving the blade member performed by the blade member moving unit is performed in association with an operation of moving the nipping members performed by the nipping member moving unit by causing the shared driving unit to operate.

4. The sheet folding apparatus according to claim 3, wherein the blade member moving unit is caused to move the blade member at an operational timing different from an operational timing at which the nipping member moving unit is caused to move the nipping members.

5. The sheet folding apparatus according to claim 1, wherein a direction of movement of the blade member between the pushing position and the position retracted from the pushing position, and a direction of movement of the nipping members between the nipping position and the position escaped from the nipping position are switched by switching a driving direction of the blade member moving unit and the nipping member moving unit by the shared driving unit.

6. The sheet folding apparatus according to claim 1, wherein the pair of nipping members include at least a pair of rollers, the pressure releasing member is inserted between the pair of rollers to separate the pair of nipping members, and the pressure releasing member is moved away from between the pair of rollers to move the pair of nipping members closer to each other.

7. The sheet folding apparatus according to claim 6, wherein the pressure releasing member includes a sloped surface, and the pressure releasing member is moved away from between the pair of rollers along the sloped surface to move the pair of nipping members gradually closer to each other.

8. The sheet folding apparatus according to claim 1, wherein the pressure releasing member includes a sloped surface, and the pressure releasing member is moved away from between the pair of nipping members along the sloped surface to move the pair of nipping members gradually closer to each other.

* * * * *